United States Patent [19]

Capdeboscq

[11] Patent Number: 4,614,512

[45] Date of Patent: Sep. 30, 1986

[54] SHEET FOLDING MACHINE

[75] Inventor: Bernard Capdeboscq, St Just Chaleyssin, France

[73] Assignee: S. A. Martin, Villeurbanne, France

[21] Appl. No.: 752,015

[22] Filed: Jul. 8, 1985

Related U.S. Application Data

[63] Continuation of Ser. No. 453,564, Dec. 27, 1982, abandoned.

[30] Foreign Application Priority Data

Feb. 4, 1982 [FR] France ..... 82 01782

[51] Int. Cl.[4] ..... B31B 1/26; B31B 1/58

[52] U.S. Cl. ..... 493/441; 493/179; 493/418; 493/423; 493/450; 198/405; 198/670.1

[58] Field of Search ..... 493/423, 441, 418, 450, 493/178, 179, 295; 198/689, 405; 271/90, 91, 184, 185, 186; 270/45

[56] References Cited

U.S. PATENT DOCUMENTS

| | | | |
|---|---|---|---|
| 2,785,609 | 3/1957 | Billeb | 493/450 |
| 3,130,650 | 4/1964 | Shields | 493/423 |
| 3,807,289 | 4/1974 | Labombarde | 493/178 |
| 3,838,771 | 10/1974 | Whiteford | 198/405 |
| 3,927,875 | 12/1975 | Winnemoller et al. | 493/441 |
| 4,022,457 | 5/1977 | Marin et al. | 493/441 |

*Primary Examiner*—Francis S. Husar
*Assistant Examiner*—Jerry Kearns
*Attorney, Agent, or Firm*—Pollock, Vande Sande & Priddy

[57] ABSTRACT

Sheet-folding machine, especially for packaging cases made of corrugated cardboard, after they have been produced and printed.

It incorporates advancing (10) and folding (22) belts which are maintained at the exact cycle of the machine by means of pulleys (14) provided with recentering fingers (15). The conveyor belts are provided with suction elements (19), and the folding belts are provided with push-studs (25) arranged to correspond to the turned-down portions (5) to be folded.

5 Claims, 10 Drawing Figures

FIG: 7
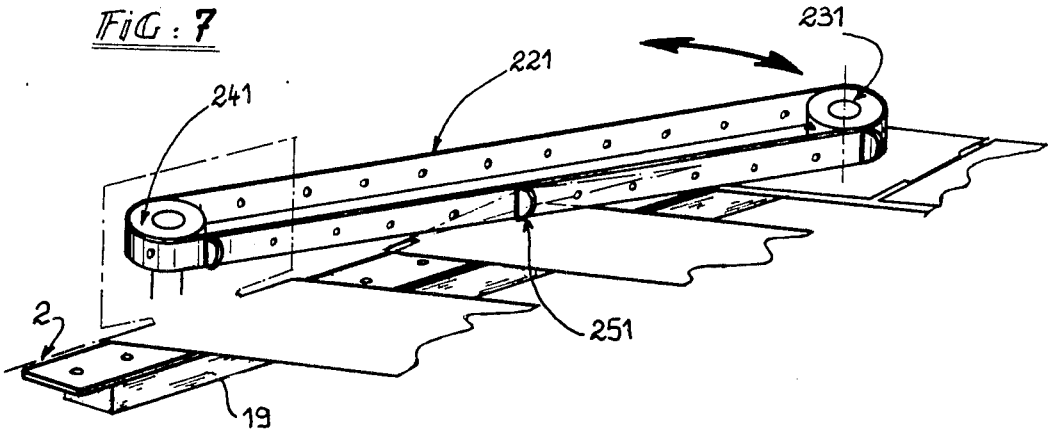
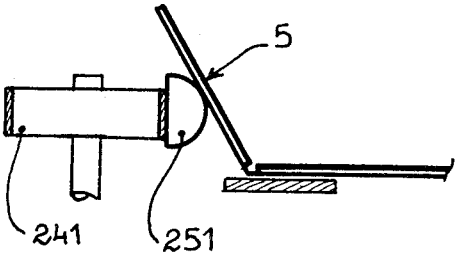
FIG: 8
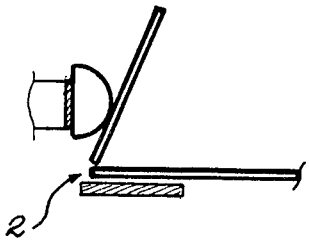
FIG: 9
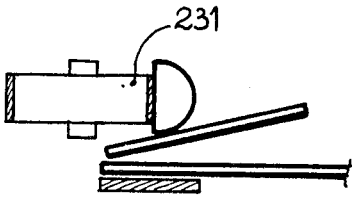
FIG: 10

SHEET FOLDING MACHINE

This application is a continuation of application Ser. No. 453,564, filed Dec. 27, 1982 and now abandoned.

FIELD OF THE INVENTION

The present invention relates to a sheet-folding machine, and more particularly to a machine intended for folding packaging cases made of corrugated cardboard after they have been produced and printed.

BACKGROUND OF THE INVENTION

The widening use of packaging cases made of corrugated cardboard requires very high production rates. Present machines are capable of producing cases at a very high rate from a cardboard sheet representing the spreadout case to be obtained. At the present time, these machines are continuous machines in which the blank passes in succession from one station to the next, without any intermediate storage. In this way, the sheet is printed, cut out to form the turned-down portions or the auxiliary cut-out portions, glued on its closing tab, and then folded and bonded up to the final station for making up into bundles for delivery to the user.

In the folding part, the transverse end panels of the blank are folded inwards and bonded to one another. Folding is generally carried out by moving the cases along an endless conveyor (with belts, chains, etc.), the central part of the blank being retained firmly between the two folding lines of the latter, the end panels bearing on inclined bars which force them to lift up or descend, depending on whether folding takes place from above or from below. The end panels are thus arranged vertically, and they are, in general, subsequently picked up by other bars which complete the folding flat.

Instead of inclined bars, it is possible to use other devices, such as:

(a) straight or spiral movable belts which have the same function, (b) oscillating flaps which are driven in a cyclical movement and which push the panels at the rate at which they pass, until they are folded flat, (c) rotating spiral bars, such as those described in U.S. Pat. No. 4,254,692, the characteristic of which is to possess a single point of contact with a corresponding panel.

All these known devices have disadvantages, among them the following:

(1) Use of endless conveyors of the conventional type, combined with the lightness of the sheets, means that the cases to be folded often do not pass through the folder in perfect synchronism with the general movement of the machine. This causes disturbances both in the operation of the folder and in that of the machine located immediately downstream of the latter.

(2) The devices cause a relative movement, in the direction of travel, between the folding elements and the cases to be folded. This relative movement causes these cases to be braked, further aggravating the folding defects in the cycle of the cases.

(3) Most of these folding elements act by bearing on the front part of the lateral panels, so that folding takes place slightly crosswise, and badly folded cases are obtained in the end. To overcome this last disadvantage, it has already been proposed, e.g., in German Patent Application No. 2,911,969, to use for auxiliary thrust movable elements driven by an endless chain, but this type of device requires a very complex mechanism which is incapable of allowing sufficient speed of advance to be obtained.

SUMMARY OF THE INVENTION

The purpose of the present invention is to provide a solution to the disadvantages of these known devices. The folder according to the invention is equipped with means contributing to carrying out the folding operation in the cycle of the general movement of the machine. Advantageously, for example, the said folder is provided with folding elements consisting of endless belts or the like, which advance at the cycle of the machine and which are provided with push-studs or the like arranged to correspond to the panels to be folded.

BRIEF DESCRIPTION OF THE DRAWINGS

The invention will be better understood by means of the following description of several exemplary embodiments, with reference to the attached drawings in which:

FIG. 7 shows, very diagrammatically and partially, a third embodiment of the folder according to the invention, and FIGS. 8, 9 and 10 are diagrammatic sections similar to FIGS. 4, 5 and 6 showing the successive phases in the folding of a blank by means of the folder of FIG. 7.

DESCRIPTION OF PREFERRED EMBODIMENT

Figure 1:
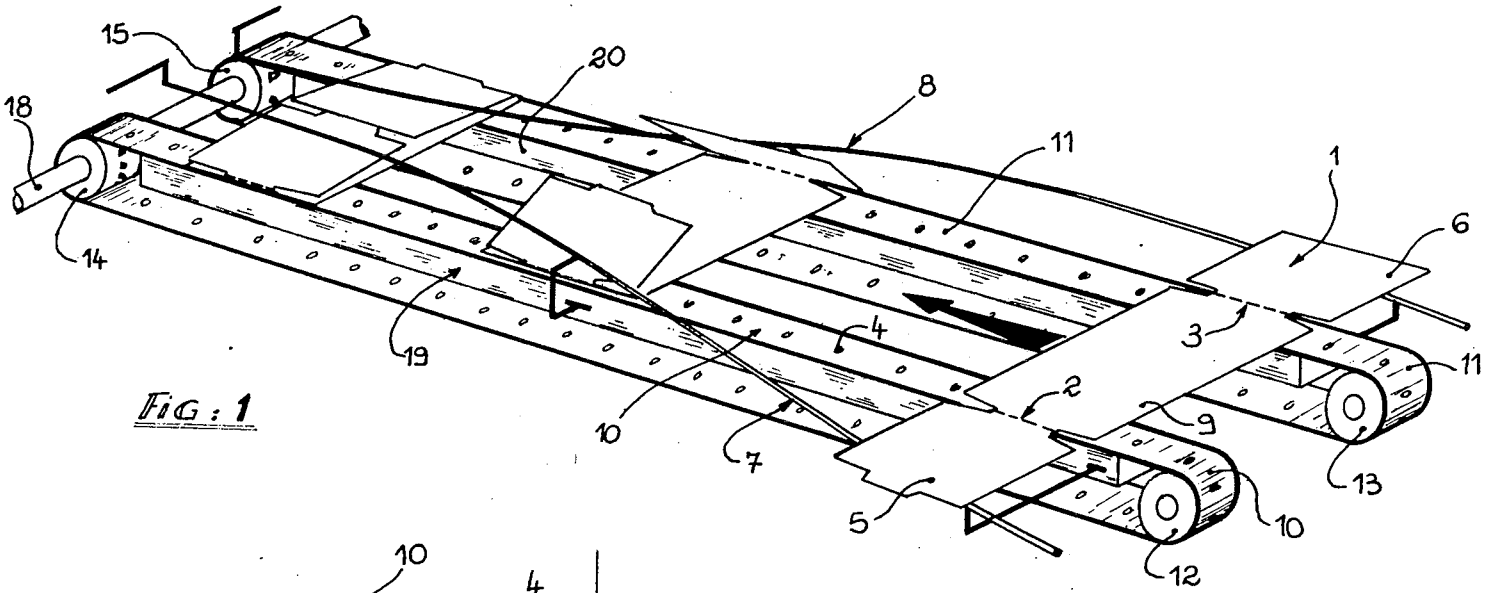
FIG. 1 is a diagrammatic perspective view of a first embodiment of a folder according to the invention.

Referring, first of all, to the general view of FIG. 1, the cardboard blanks are introduced into the machine in the form of sheets 1 provided with two longitudinal marks (2, 3) obtained previously by compressing or "creasing" the cardboard. These marks form hinges about which the turned-down portions 5 and 6 will be folded.

Folding is carried out as a result of longitudinal movement of the blank 1 along the folder. When the turned-down portions (5, 6) encounter folding elements, consisting here of two conventional spiral bars (7, 8), these turned-down portions are rotated about the corresponding hinges (2, 3) 180° to the right and to the left, respectively, until the turned-down portions are superposed above the central part 9 of the blank 1, the whole of this first part of the device being highly conventional.

Figure 2:
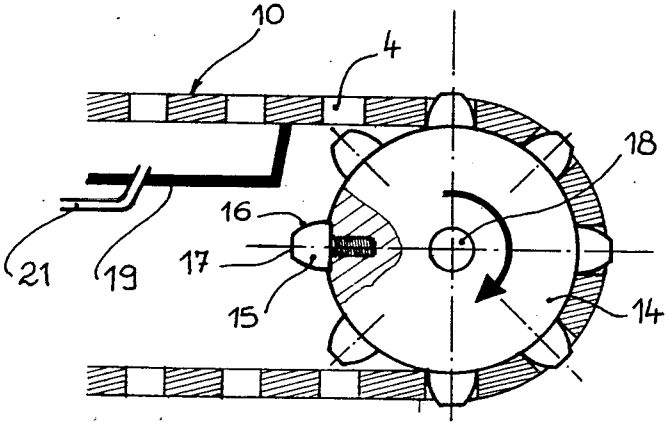
FIG. 2 is a longitudinal section through one of the ends of the conveyor equipping the folder of FIG. 1.

According to the invention, the blanks 1 are then transported through the folder by means of a conveyor comprising two endless belts (10, 11) perforated with holes 4 distributed uniformly in a longitudinal direction, as may be seen clearly in FIG. 2. The center-to-center distance between these holes 4 is adjusted so as to allow them to engage in the corresponding upstream (12, 13) and downstream (14, 15) end pulleys, each of the said pulleys consequently being provided with uniformly distributed fingers 115.

Each finger 115 has a pointed shape, albeit having a flattened upper portion 17, and has lateral profiles 16 substantially in the form of portions of an involute of a circle, as may be seen in FIG. 2.

The upstream pulleys 12 and 13 are mounted loosely, while the downstream pulleys 14 and 15 are fixed to a shaft 18 driven to rotate as a result of the general movement of the machine. The drive pulleys 14 and 15 thus ensure that the conveyor belts 10 and 11 advance at the cycle of the machine, while the holes 4, in combination with the associated fingers 115, allow permanent recentering of the said belts, continuously correcting their movement, especially counter to their fluctuations in length, and thereby guaranteeing that they are synchronized perfectly with the cycle. Holes 4 also serve as suction orifices, making it possible to guarantee that the central part 9 of the blanks 1 is laid on the active parts of the conveyor belts 10 and 11, and therefore to guarantee that they are advanced at the cycle of the machine, this being one of the essential aims of the invention. Consequently, a suction box 19 and 20 respectively, connected to a vacuum pump by pipes 21 (FIG. 2), is located under each conveyor belt (10, 11).

The folder which has just been described has the advantage of guaranteeing the advance of the sheets at the cycle of the machine. However, it makes use of conventional folding elements (7, 8) which have the disadvantage, with some types of cardboard, that there is a risk that the turned-down portions will be folded slightly crosswise. Two embodiments according to the invention, using new folding elements which though being more expensive do not give rise to this disadvantage, will now be described.

In general terms, these embodiments make use of push-studs which are moved, by means of belts, chains, cables or the like, at the cycle of the machine, i.e., exactly the same theoretical speed as the sheets to be folded, bearing progressively on the turned-down portions to be folded. In this way, by placing several devices end to end, it is possible to achieve folding of the turned-down portions from 0 to 180°. The location of the bearing points of the studs on each turned-down portion can be adjusted in such a way that they do not bear on its front part, as is the case, for example, with the folding bars of the prior art. Briefly, with this type of device, everything takes place as though two slaves were folding the two turned-down portions by pushing laterally on these, while moving in the same direction as the cases and at the same speed. Such a result could be achieved by means of oscillating flaps which would be carried by an auxiliary conveyor moving at the speed of the conveyor supporting the sheets, but such a device would be much more complex to produce than the push-stud devices with which the invention is concerned.

Referring now to FIGS. 3 to 6 as a whole, the folding bars 7 and 8 of FIG. 1 are replaced, in this embodiment, by an assembly of endless spiral belts 22, each rotating at the cycle of the machine about end pulleys (23, 24) driven by the pulleys 12 of the conveyor 10 and carrying groups of push-studs 25 at regular intervals corresponding to the distance between two blanks on the conveyor 10.

Figure 4:
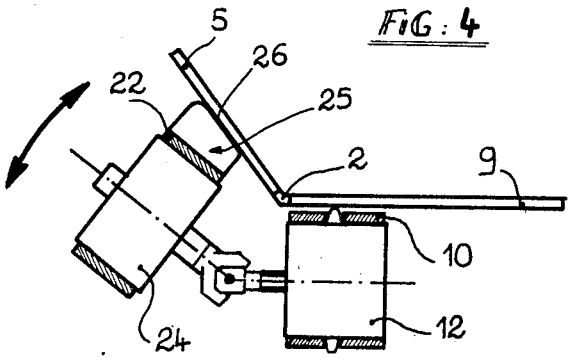
FIGS. 4, 5 and 6 are diagrammatic sections showing the successive phases in the folding of a cardboard blank by means of the folder of FIG. 3.
Figure 5:
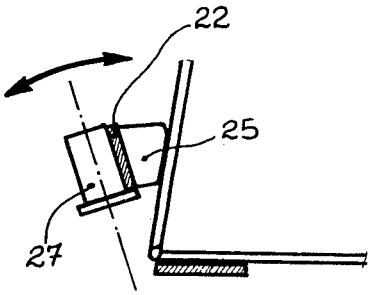
Figure 6:
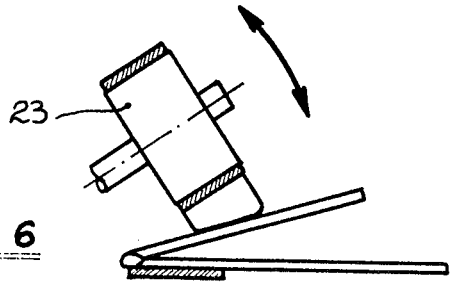

As may be seen in the sectional views of FIGS. 4 to 6, the belts 22 are positioned in such a way that their "forward" or active side is aligned with the associated hinge 2, as indicated by the extension shown by broken lines, and the studs 25 have such a cross-section that the same is true of their supporting face 26. The belts 22 are provided with identical holes 4 as the conveyor belts 10 and 11 of FIG. 1, and the end pulleys 23 and 24 are likewise provided with correcting fingers 115 identical to those described above with reference to FIG. 2. Moreover, an assembly of small intermediate pulleys 27 makes it possible to maintain the belt 22 on the desired spiral path, allowing the turned-down portion 5 to be folded progressively on the central part 9 of the blank.

Folding carried out by each belt 22 is adjusted by acting on the relative positions of the pulleys 23, 24 and 27. In the example under consideration, the belt 22 folds the turned-down portion 5 through an angle of approximately 90°, and consequently the end pulleys 24 and 23 have the positions shown respectively in FIGS. 4 and 6. Folding takes place progressively, as appears clearly from the three successive phases shown diagrammatically in FIGS. 4 to 6.

Figure 3:
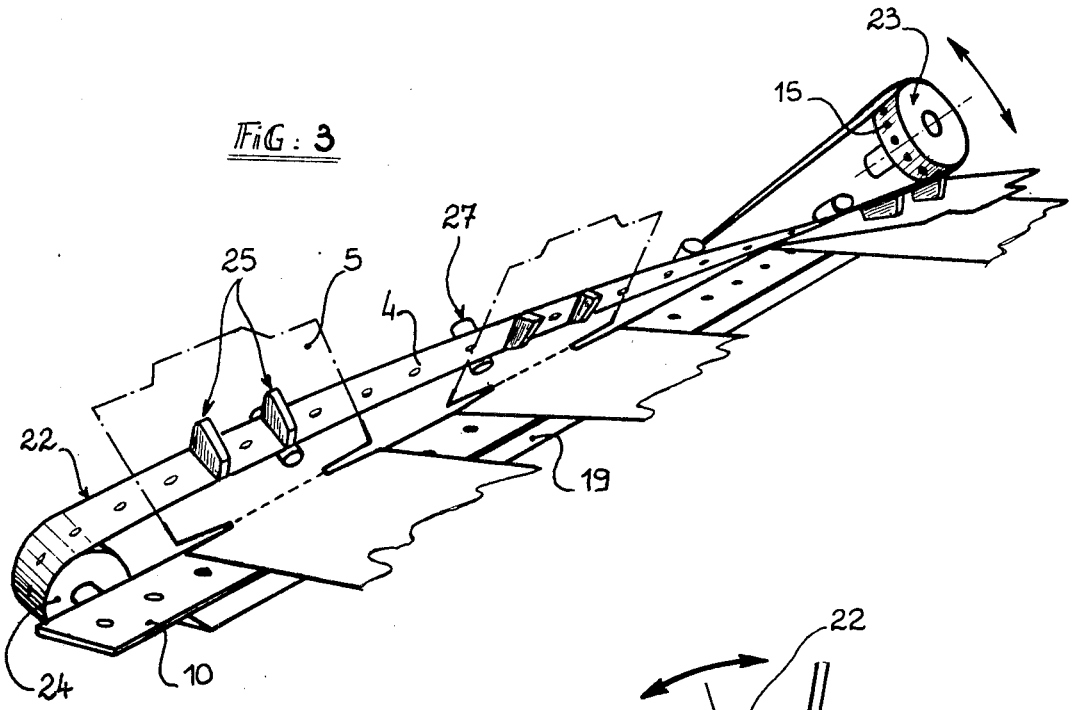
FIG. 3 is a partial diagrammatic view of a second embodiment of the folder according to the invention.

It goes without saying that the folder of FIG. 3 incorporates at least one pair of belts 22 which is located upstream of that illustrated and which is responsible for carrying out the folding from 0 to approximately 90°, and, if necessary, another pair downstream to complete the folding to 180°. The respective positions of the end pulleys are adjusted as a function of the folding desired, and are easily determined, as in FIGS. 4 and 6, so that the upstream pulley ensures, together with a stud 25, the position of initial folding and so that the downstream pulley ensures, together with a stud 25, the position of final folding.

In a simplified alternative form, it would very easily be possible to install only a single pair of belts 22 to carry out folding according to FIGS. 4 to 6, and to provide for the rest of the folding operation conventional elements such as folding bars.

FIGS. 7 to 10 show an embodiment close to that of FIG. 3, but using non-spiral, i.e., straight belts 221, which are provided with push-studs 251 having a cross-section which is rounded, in this particular case semicircular. As illustrated in FIGS. 7, 8, 9 and 10 (corresponding respectively to FIGS. 3, 4, 5 and 6 in the preceding embodiment), the folding carried out is adjusted by means of the automatic parallel movement of the upstream guide pulley 241 and downstream guide pulley 231.

In the example illustrated, in which folding is carried out from 90 to 180° approximately, the axes of the end pulleys (241, 231) are vertical and are located respectively on the far side and on the near side of the folding axis 2, i.e., on either side of the latter in a horizontal plane. To carry out folding from 0 to 90°, an identical assembly, but with end pulleys having horizontal axes located on either side of the folding axis 2 in a vertical plane, will be placed upstream of the assembly (221, 231, 241) illustrated.

The invention is not limited to the examples which have just been described. Other forms of push-studs carried by other forms of belts, cables or chains, e.g., push-studs consisting of discs rotating on themselves and carried by a ball cord, could easily be used.

I claim:

1. Apparatus for folding sheets (1) having flaps (5) each having fold lines (2), comprising (a) a conveyor (10, 11) for sheets to be folded, provided with means (4, 14, 15) enabling said sheets to be advanced and means (19, 20) for retaining central portions (9) of said sheets flat on said conveyor for advancement in precise correspondence therewith; and (b) lateral push folding means at least a portion of which is constituted by at least one endless spiral belt (22) directly carrying push studs located along said at least one belt in correspondence with successive sheets on said conveyor, and having support faces (26) in alignment with said fold lines;

(c) said at least one endless belt (22) being disposed at an angle to said conveyor such that said push studs progressively push down said flaps of said sheets to be folded, and having means (23, 24, 115) enabling it to advance at the same predetermined speed as said sheets to be folded, whereby misfolding of said sheets is prevented.

2. Apparatus for folding sheets (1) having flaps (5) each having fold lines (2), comprising (a) a conveyor (10, 11) for sheets to be folded, provided with means (4, 14, 15) enabling said sheets to be advanced and means (19, 20) for retaining central portions (9) of said sheets flat on said conveyor for advancement in precise correspondence therewith; and (b) lateral push folding means at least a portion of which is constituted by at least one straight endless belt (221) directly carrying push studs (251) having rounded shapes located along said at least one belt in correspondence with successive sheets on said conveyor, said at least one endless belt (221) being disposed at an angle to said conveyor such that said push studs progressively push down said flaps of said sheets to be folded, said endless belt (221) moving on end pulleys (231, 241) whose axes are parallel to a starting position of said flaps (5) and located on either side of said fold lines (2), said pulleys enabling said endless belt (221) to advance at the same predetermined speed as said sheets to be folded, whereby misfolding of said sheets is prevented.

3. Apparatus according to claim 1 or 2, wherein said conveyor comprises at least one belt (10, 11) perforated with holes (4) distributed uniformly in a longitudinal direction, the center-to-center distance between said holes being such as to allow them to engage fingers (115) uniformly distributed on at least one drive pulley (14), said fingers having lateral profiles substantially in the form of portions of an involute of a circle.

4. Apparatus according to claim 3, wherein said means (19, 20) for retaining central portions of said sheets comprises means for applying suction through said holes (4) in order to flatten said sheets (1) on said conveyor belt.

5. Apparatus according to claim 2, wherein said push studs (251) have semi-circular sections.

* * * * *